US006665510B1

(12) United States Patent
Hirsch

(10) Patent No.: US 6,665,510 B1
(45) Date of Patent: Dec. 16, 2003

(54) APPARATUS AND METHOD FOR REDUCING GHOSTING DEFECTS IN A PRINTING MACHINE

(75) Inventor: Mark J. Hirsch, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/165,705

(22) Filed: Jun. 7, 2002

(51) Int. Cl.[7] ..... G03G 15/08
(52) U.S. Cl. ..... 399/265
(58) Field of Search ..... 399/252, 253, 399/254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 290, 291, 389, 53, 127

(56) References Cited

U.S. PATENT DOCUMENTS 4,063,533 A * 12/1977 White ..... 399/269
5,032,872 A 7/1991 Folkins et al. ..... 399/266
5,300,987 A * 4/1994 Aoyama et al. ..... 399/269
5,923,432 A 7/1999 Kral ..... 356/432
6,269,235 B1 * 7/2001 Nishiyama ..... 399/267

FOREIGN PATENT DOCUMENTS

JP 07092814 A * 4/1995 ..... G03G/15/08

* cited by examiner

*Primary Examiner*—Arthur T. Grimley
*Assistant Examiner*—Ryan Gleitz
(74) *Attorney, Agent, or Firm*—Lloyd F. Bean, II

(57) ABSTRACT

An apparatus for developing a latent image recorded on a movable imaging surface, including: a reservoir for storing a supply of developer material; a first donor member and a second donor member, the first and second donor members both being arranged to receive toner particles from the reservoir and to deliver toner particles to the image surface at locations spaced apart from each other in the direction of movement of the imaging surface thereby to develop the latent image thereon; and system for moving the outer surface of first donor member at a first velocity; and system for moving the outer surface of second donor member at a second velocity; wherein the first velocity could be slightly different than the second velocity to reduce a ghosting print defect.

10 Claims, 5 Drawing Sheets

APPARATUS AND METHOD FOR REDUCING GHOSTING DEFECTS IN A PRINTING MACHINE

This invention relates generally to development systems using donor rolls for ionographic or electrophotographic imaging and printing apparatuses and machines, and more particularly is directed to a method to improve the appearance of a ghosting print defect in such a developer unit.

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

One common type of development system uses one or more donor rolls to convey toner to the latent image on the photoconductive member. A donor roll is loaded with toner either from a two-component mixture of toner and carrier or from a single-component supply of toner. The toner is charged either from its triboelectric interaction with carrier beads or from suitable charging devices such as frictional or biased blades or from other charging devices. As the donor roll rotates it carries toner from the loading zone to the latent image on the photoconductive member. There, suitable electric fields can be applied with a combination of dc and ac biases to the donor roll to cause the toner to develop to the latent image. Additional electrodes, such as those used in the Hybrid Scavengeless Development (HSD) technology may also be employed to excite the toner into a cloud from which it can be harvested more easily by the latent image.

A problem with donor roll developer systems is a defect known as ghosting or reload, which appears as a lightened ghost image of a previously developed image in a halftone or solid on a print. The defect is due to the different characteristics of the toner that has been reloaded onto the recently detoned areas of the donor roll.

Figure 1:
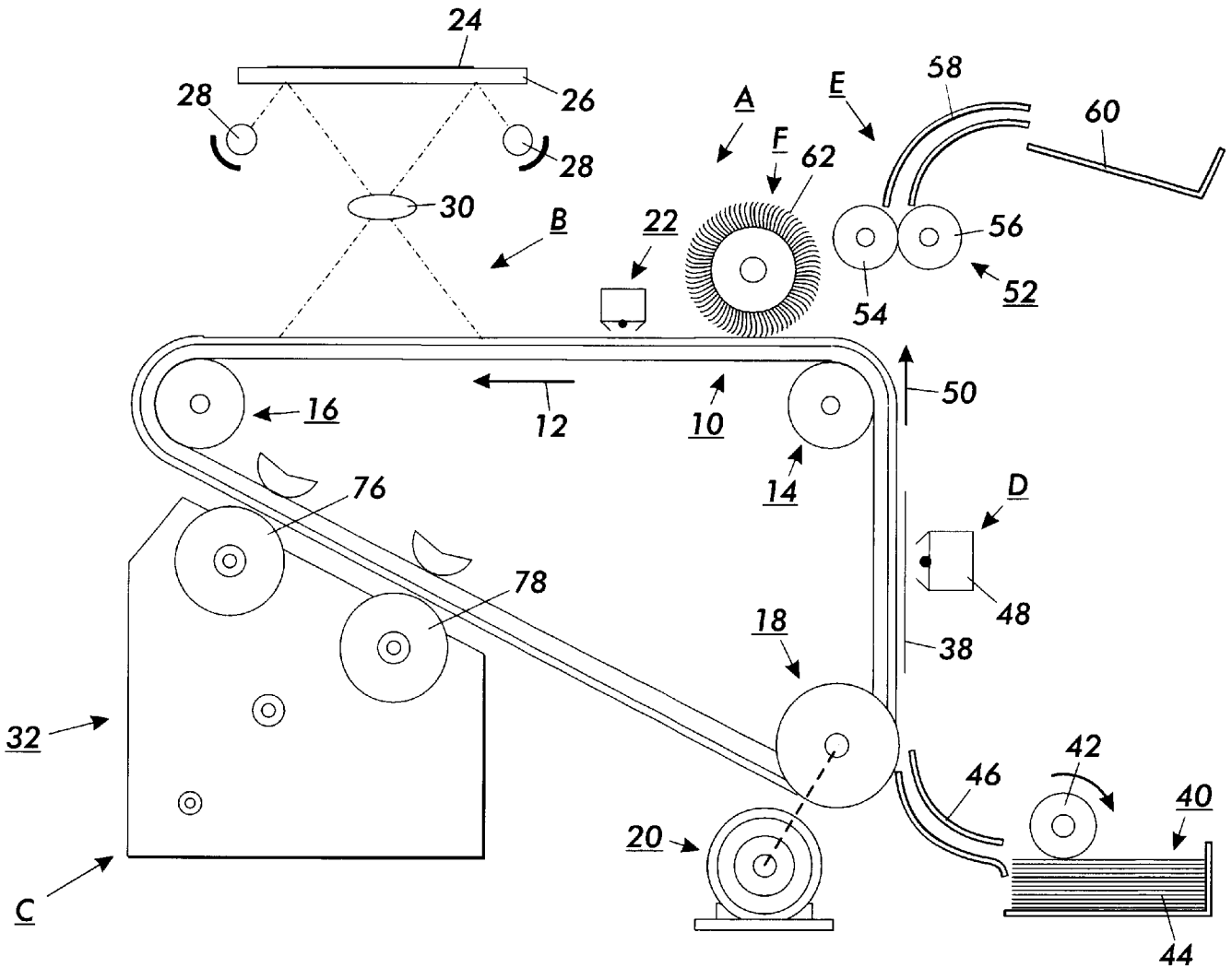
Figure 2:
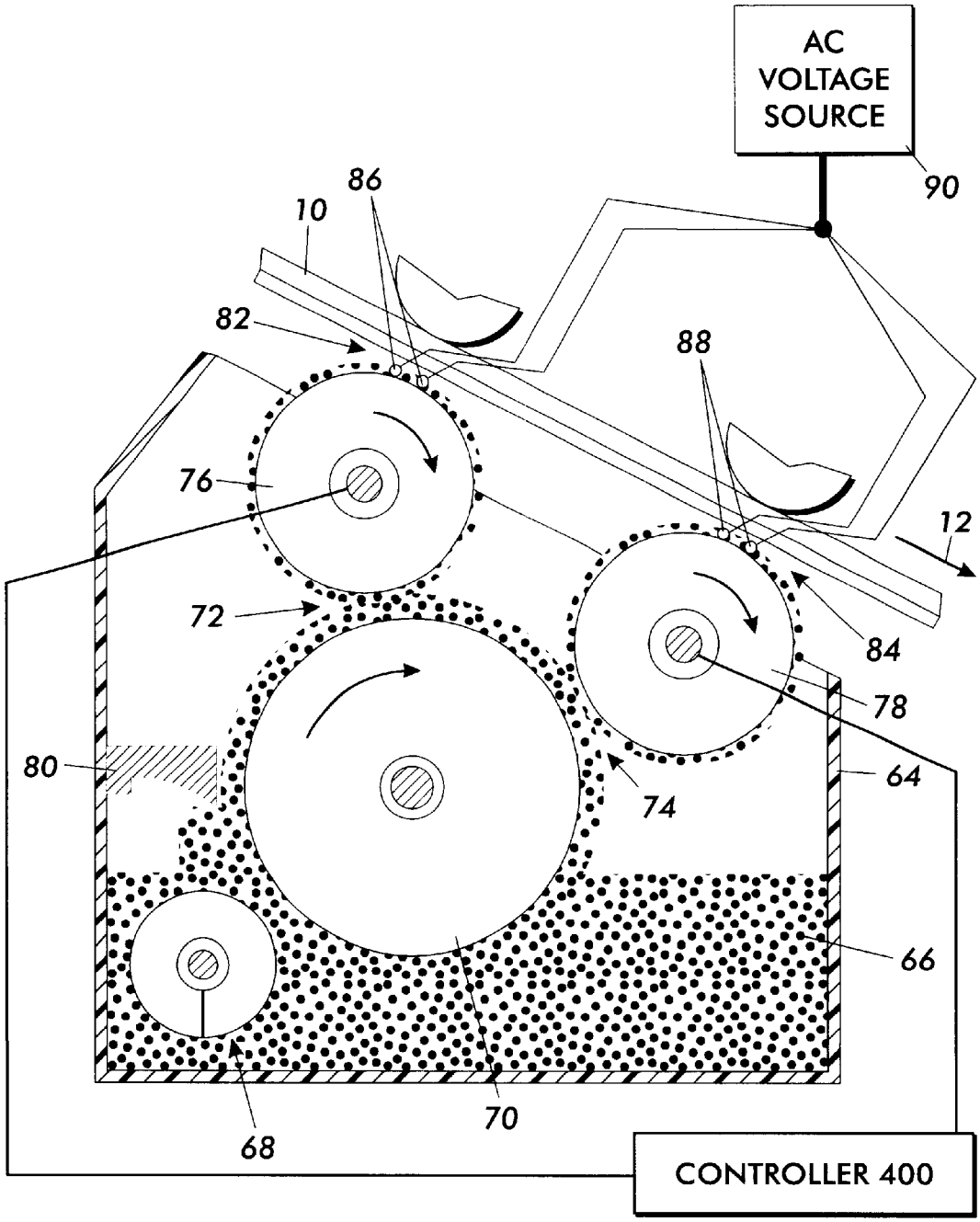

By way of example, an embodiment of the invention will be described with reference to the accompanying drawings, in which:

FIG. 1 is a schematic elevational view depicting an illustrative electrophotographic printing machine incorporating the development apparatus of the present invention therein; and FIG. 2 is a schematic elevational view showing the development apparatus of the FIG. 1 printing machine in greater detail.

Figure 3:
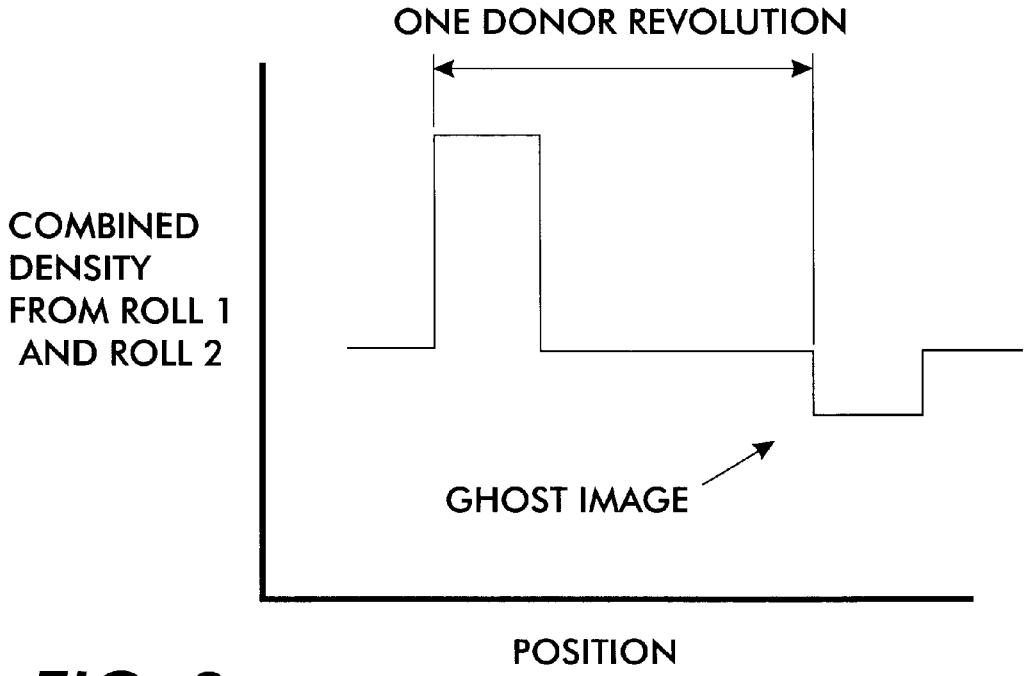
Figure 4:
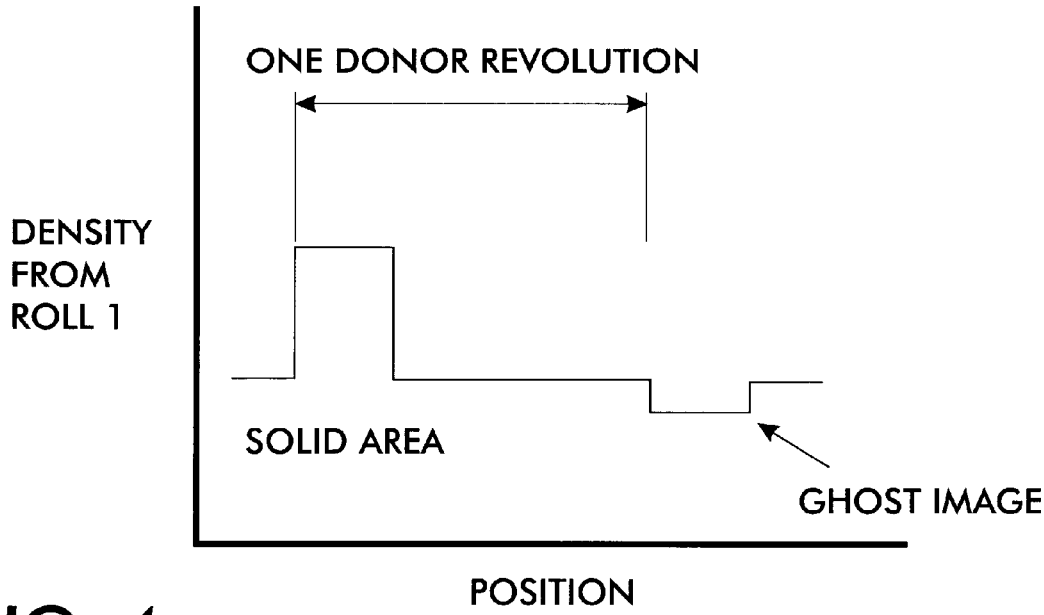
Figure 5:
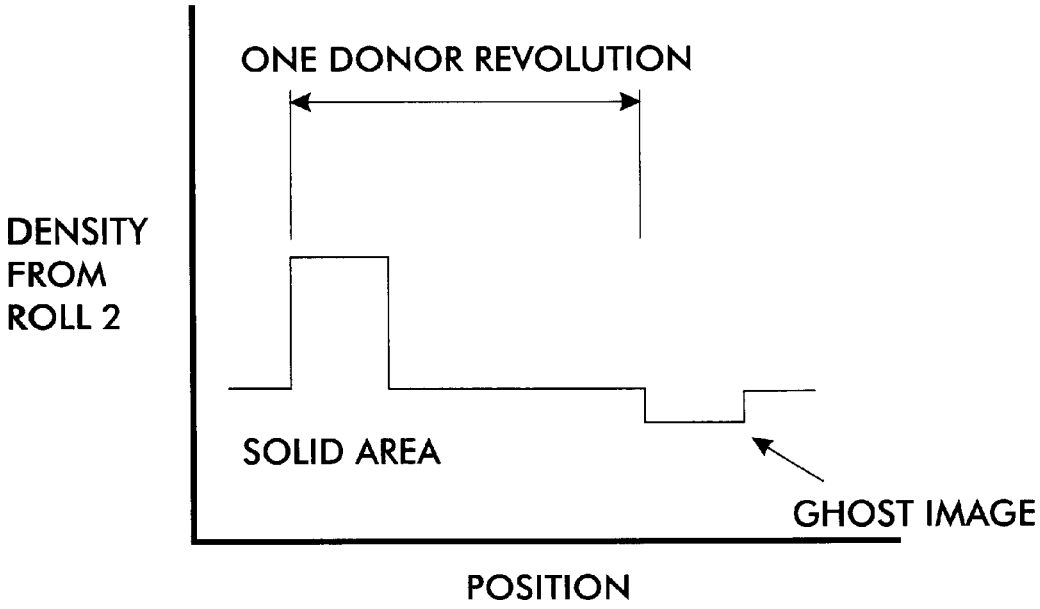

FIGS. 3, 4, and 5 show a plot of density vs. position along the process direction for a print containing a solid area followed by a lighter density halftone that contains the ghost image of the solid.

Figure 6:
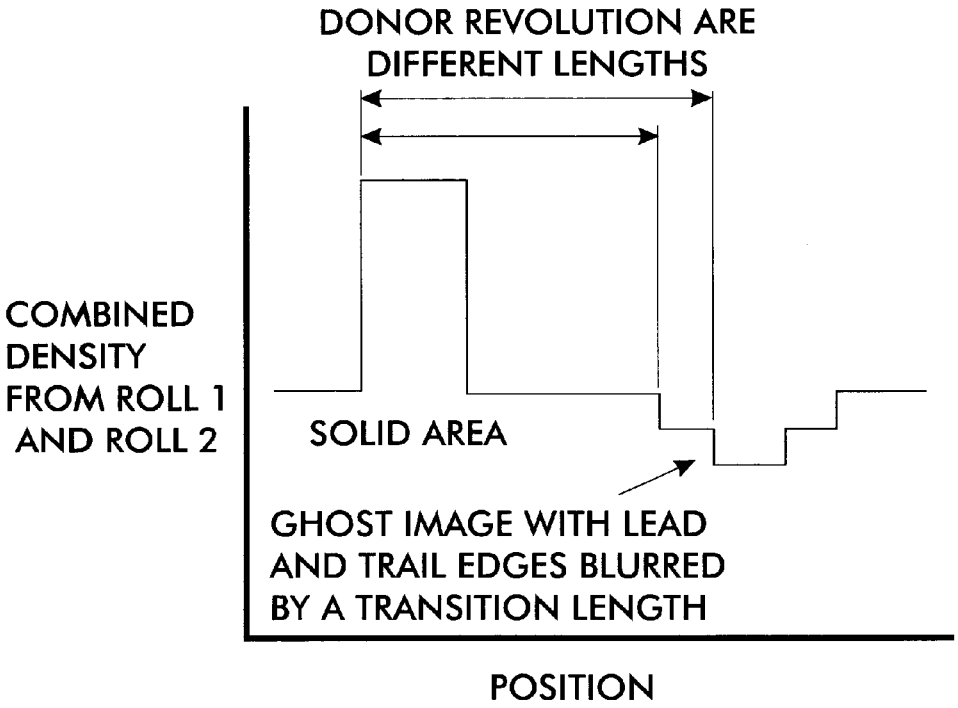
Figure 7:
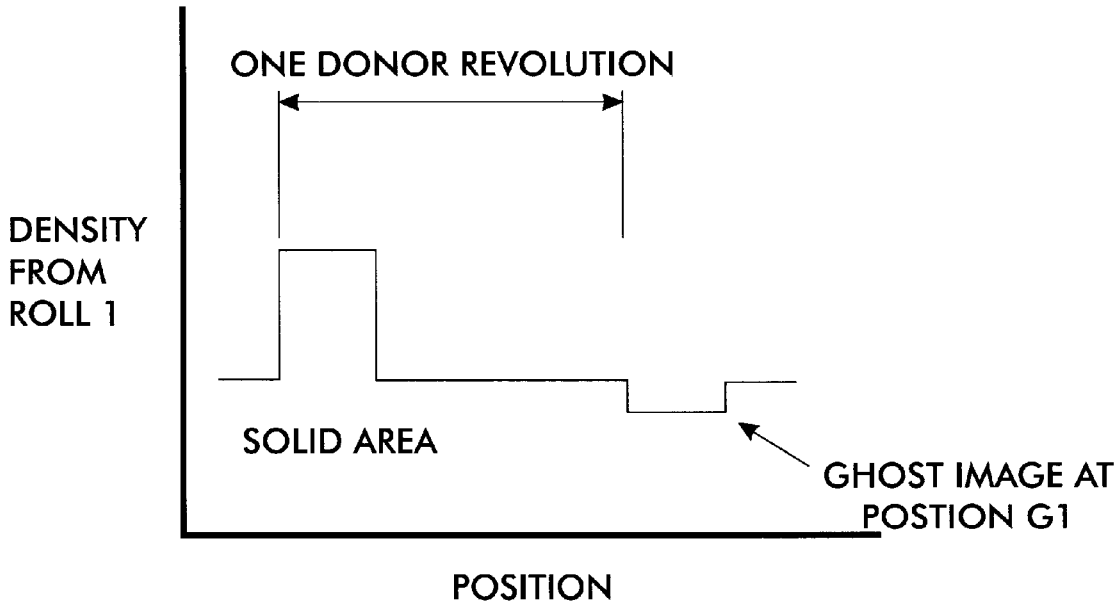
Figure 8:
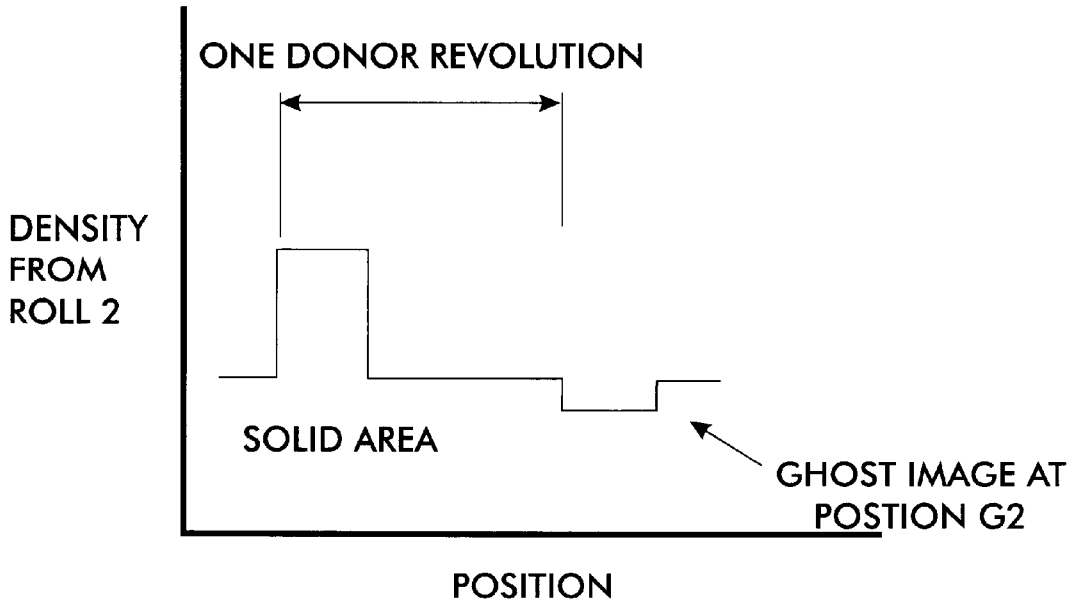

FIGS. 6, 7, and 8 illustrate the resulting ghost image will have a blurred lead and trail edge, since the transition from nominal density to the reduced density of the ghost occurs over a transition region that is as wide as the separation of the two individual ghost images.

In the drawings, like reference numerals have been used throughout to designate identical elements. FIG. 1 schematically depicts the various components of an illustrative electrophotographic printing machine incorporating the development apparatus of the present invention. It will become evident from the following discussion that this development apparatus is equally well suited for use in a wide variety of electrostatographic printing machines and for use in ionographic printing machines. Because the various processing stations employed in the FIG. 1 printing machine are well known, they are shown schematically and their operation will be described only briefly.

The printing machine shown in FIG. 1 employs a photoconductive belt 10 of any suitable type, which moves in the direction of arrow 12 to advance successive portions of the photoconductive surface of the belt through the various stations disposed about the path of movement thereof. As shown, belt 10 is entrained about rollers 14 and 16 which are mounted to be freely rotatable and drive roller 18 which is rotated by a motor 20 to advance the belt in the direction of the arrow 12. Initially, a portion of belt 10 passes through a charging station A. At charging station A, a corona generation device, indicated generally by the reference numeral 22, charges a portion of the photoconductive surface of belt 10 to a relatively high, substantially uniform potential. Next, the charged portion of the photoconductive surface is advanced through an exposure station B. At exposure station B, an original document 24 is positioned face down upon a transparent platen 26. Lamps 28 flash light onto the document 24 and the light that is reflected is transmitted through lens 30 forming a light image on the charged portion of the photoconductive surface. The charge on the photoconductive surface is selectively dissipated, leaving an electrostatic latent image on the photoconductive surface which corresponds to the original document 24 disposed upon transparent platen 26. The belt 10 then advances the electrostatic latent image to a development station C.

At development station C, a development apparatus indicated generally by the reference numeral 32, transports toner particles to develop the electrostatic latent image recorded on the photoconductive surface. The development apparatus 32 will be described hereinafter in greater detail with reference to FIG. 2. Toner particles are transferred from the development apparatus to the latent image on the belt, forming a toner powder image on the belt, which is advanced to transfer station D.

At transfer station D, a sheet of support material 38 is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D. Transfer station D includes a corona generating device 48 which sprays ions onto the back side of sheet 38. This attracts the toner powder image from the photoconductive surface to sheet 38. After transfer, the sheet continues to move in the direction of arrow 50 into a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38.

After fusing, chute 58 guides the advancing sheet to catch tray 60 for subsequent removal from the printing machine by the operator. Invariably, after the sheet of support material is separated from the photoconductive surface of belt 10, some residual toner particles remain adhering thereto. These residual particles are removed from the photoconductive surface at cleaning station F.

Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 in contact therewith. Subsequent to cleaning, a discharge lamp (not shown) floods the photoconductive surface with light to dissipate any residual charge remaining thereon prior to the charging thereof for the next successive imaging cycle.

Referring now to FIG. 2, there are shown the details of the development apparatus 32. The apparatus comprises a reservoir 64 containing developer material 66. The developer material 66 is of the two component type, that is it comprises carrier granules and toner particles. The reservoir includes augers, indicated at 68, which are rotatably-mounted in the reservoir chamber. The augers 68 serve to transport and to agitate the material within the reservoir and encourage the toner particles to adhere triboelectrically to the carrier granules. A magnetic brush roll 70 transports developer material from the reservoir to the loading nips 72, 74 of two donor rolls 76, 78. Magnetic brush rolls are well known, so the construction of roll 70 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 70 rotates, the granules (with toner particles adhering triboelectrically thereto) are attracted to the roll 70 and are conveyed to the donor roll loading nips 72, 74. A metering blade 80 removes excess developer material from the magnetic brush roll and ensures an even depth of coverage with developer material before arrival at the first donor roll loading nip 72. At each of the donor roll loading nips 72, 74, toner particles are transferred from the magnetic brush roll 70 to the respective donor roll 76, 78.

Each donor roll transports the toner to a respective development zone 82, 84 through which the photoconductive belt 10 passes. Transfer of toner from the magnetic brush roll 70 to the donor rolls 76, 78 can be encouraged by, for example, the application of a suitable D.C. electrical bias to the magnetic brush and/or donor rolls. The D.C. bias (for example, approximately 100 v applied to the magnetic roll) establishes an electrostatic field between the donor roll and magnetic brush rolls, which causes toner particles to be attracted to the donor roll from the carrier granules on the magnetic roll.

The carrier granules and any toner particles that remain on the magnetic brush roll 70 are returned to the reservoir 64 as the magnetic brush continues to rotate. The relative amounts of toner transferred from the magnetic roll 70 to the donor rolls 76, 78 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 82, 84, toner is transferred from the respective donor roll 76, 78 to the latent image on the belt 10 to form a toner powder image on the latter. Various methods of achieving an adequate transfer of toner from a donor roll to a photoconductive surface are known and any of those may be employed at the development zones 82, 84.

In FIG. 2, each of the development zones 82, 84 is shown as having the form i.e. electrode wires are disposed in the space between each donor roll 76, 78 and belt 10. FIG. 2 shows, for each donor roll 76, 78, a respective pair of electrode wires 86, 88 extending in a direction substantially parallel to the longitudinal axis of the donor roll. The electrode wires are made from thin (i.e. 50 to 100 micron diameter) wires which are closely spaced from the respective donor roll when there is no voltage difference between the wires and the roll. The distance between each wire and the respective donor roll is within the range from about 10 microns to about 40 microns (typically approximately 25 microns). The wires are self-spaced from the donor rolls by the thickness of the toner on the donor rolls. To this end the extremities of the wires are supported by the tops of end bearing blocks that also support the donor rolls for rotation. The wire extremities are attached so that they are slightly above a tangent to the surface of the donor roll structure. An alternating electrical bias is applied to the electrode wires by an AC voltage source 90.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage is on the order of 200 to 500 volts peak at a frequency ranging from about 3 kHz to about 15 kHz. A DC bias supply (not shown) applied to each donor roll 76, 78 establishes electrostatic fields between the belt 10 and donor rolls for attracting the detached toner particles from the clouds surrounding the wires to the latent image recorded on the photoconductive surface of the belt. At a spacing ranging from about 10 microns to about 40 microns between the electrode wires and donor rolls, an applied voltage of 200 to 500 volts produces a relatively large electrostatic field without risk of air breakdown.

As successive electrostatic latent images are developed, the toner particles within the developer material 66 are depleted. A toner dispenser (not shown) stores a supply of toner particles. The toner dispenser is in communication with reservoir 64 and, as the concentration of toner particles in the developer material is decreased, fresh toner particles are furnished to the developer material in the reservoir. The auger 68 in the reservoir chamber mixes the fresh toner particles with the remaining developer material so that the resultant developer material therein is substantially uniform with the concentration of toner particles being optimized. In this way, a substantially constant amount of toner particles is in the reservoir with the toner particles having a constant charge.

The use of more than one development zone, for example two development zones as at 82, 84 in FIG. 2, is desirable to ensure satisfactory development of a latent image, particularly at increased process speeds. If required, the development zones can have different characteristics, for example, through the application of a different electrical bias to each of the donor rolls. Thus, the characteristics of one zone may be selected with a view to achieving optimum line development, with the transfer characteristics of the other zone being selected to achieve optimum development of solid areas.

The apparatus shown in FIG. 2 combines the advantage of two development nips with the well established advantage offered by use of magnetic brush technology with two-component developer namely high volume reliability. With only a single magnetic brush roll 70, enabling a significant reduction in cost and a significant saving in space to be achieved compared with apparatus in which there is a respective magnetic brush roll for each donor roll. If more than two donor rolls are used then, depending on the layout of the system, it may be possible for a single magnetic brush roll to supply toner to more than two donor rolls.

In the arrangement shown in FIG. 2, the donor rolls 76, 78 and the magnetic brush roll 70 can be rotated either "with" or "against" the direction of motion of the belt 10. The two-component developer 66 used in the apparatus of FIG. 2 may be of any suitable type. However, the use of an electrically-conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

Ghosting, also known as reload, is a defect inherent to donor roll development technologies. It occurs both for single-component as well as hybrid systems, in which the toner layer on the donor roll is loaded by a magnetic brush. Generally, when an image is developed to a photoreceptor a negative of the image is left on the donor roll. It is found that this negative of the image, or ghost, persists to some extent even after it passes through the donor loading nip. Depending on the exact conditions of the loading nip, the ghost can persist as a mass difference, a tribo difference, a toner size difference, or a combination of these to give a toner layer voltage difference. Even subtle differences in these quantities can lead to differential development as the reloaded ghost image develops to the photoreceptor during its next rotation. A stress image pattern to quantify ghosting would be a solid area followed by a mid-density fine halftone at the position in the print corresponding to one donor roll revolution after the solid. Attempts to minimize the ghosting defect have focussed on improving the donor loading so that the differences in toner layer properties between a ghost image its surroundings are minimized after the reload step. While successful to some degree, ghosting is a problem that still limits system latitude in all donor roll development technologies.

Donor roll development systems produce an image ghost at a position on the print corresponding to one donor roll revolution after the image. If multiple donor rolls are used, each roll produces a ghost image. For development systems that use more than one donor roll, the applicant has found that the speeds or diameters of the rolls should be chosen so that the ghost images from the rolls do not coincide with each other. This partially blurs the resultant ghost image (along the lead and trail edges) and thus makes the defect less objectionable.

Each donor roll in a development housing that uses multiple donor rolls creates its own ghost image. This invention proposes that the rolls should be rotated in such a way as to not overlap the ghost image edges produced by the different rolls. Specifically, the edges of multiple ghost images should be spread over a print length of at least 2 mm, and preferably in the range of 5–20 mm, to avoid the maximum sensitivity of the eye to spatial density fluctuations.

Consider a development system with two donor rolls. The ghost image of the first roll occurs at a position G1 after the original image on the photoreceptor $$G1=Upr*2\pi r1/Ud1 \quad (1)$$

Where Upr is the speed of the photoreceptor, r1 is the radius of the first donor roll, and Ud1 is the surface speed of the first donor roll. This relation holds for either direction of rotation of the donor. If the second donor roll has the same radius and is rotated at the same speed, its ghost image falls in exactly the same position relative to the PR image i.e., the two ghost images fall exactly on top of one another. This occurs whether or not both rolls are rotating with the PR, against the PR, or in opposite directions. It is also independent of the spacing between the donor rolls. Schematically, the situation is indicated in FIGS. 3, 4, and 5 which shows a plot of density vs. position along the process direction for a print containing a solid area followed by a lighter density halftone that contains the ghost image of the solid.

However, if either the speed or the diameter of the second donor roll is different from the first, the ghost images of the two rolls will not coincide. There will be a mismatch along the lead and trail edges of the ghost image. This situation is shown schematically in FIGS. 6, 7, and 8. The resulting ghost image will have a blurred lead and trail edge, since the transition from nominal density to the reduced density of the ghost occurs over a transition region that is as wide as the separation of the two individual ghost images.

How much should the individual ghost images be separated? That is, how wide should the transition region between the nominal density and the reduced density of the ghost image be? The eye is most sensitive to spatial frequency of about 1 cy/mm when held at a typical viewing distance. A substantial decrease in sensitivity occurs for spatial frequencies of 0.1 cy/mm (10 mm spatial period), but little is gained by further decreasing the spatial frequency. This suggests that the transition region should be at least 5 mm wide to take full effect of the mismatch to improve the appearance of the defect. (The transition from dark to light is a half period of a full wavelength. Thus the distance of 5 mm for a light to dark transition corresponds to a full period of 10 mm) Partial benefits can be achieved with transition regions between 2 and 5 mm in width.

A mismatch of 5 mm between two ghost images can be accomplished with surprisingly minor changes to a pair of donor rolls that are nominally set to run at the same speed. Referring to equation 1, the difference in ghost positions (transition length) for donor rolls with radii r1 and r2 running at surface speeds of Ud1 and Ud2 is $$\text{Transition Length}=2\pi Upr*((r1/Ud1)-(r2/Ud2)).$$

For instance, in a machine when donor rolls run about 30 in/s surface speed and are 30 mm in diameter, while the PR speed is 468 mm/s. One can calculate that a difference in donor speeds of only 2.5 in/s, about a 5% speedup of one roll and a 5% slowdown of the other, would generate a 5 mm separation on ghost images. Such small speed changes are normally within the noise of optimizations to determine the overall speeds of the donor rolls, which can be controlled by controller 400 in FIG. 2. Speed changes are one way to achieve the separation of ghost images, but note that one could also use different donor diameters.

It is, therefore, apparent that there has been provided in accordance with the present invention, an apparatus for developing a latent image with reduced ghosting that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternative, modifications and variations that fall within the spirit and broad scope of the appended claims.

I claim:

1. An apparatus for developing a latent image recorded on a movable imaging surface, including:

a reservoir for storing a supply of developer material;

a first donor member and a second donor member, said first and second donor members both being arranged to receive toner particles from said reservoir and to deliver toner particles to the image surface at locations spaced apart from each other in the direction of movement of the imaging surface thereby to develop the latent image thereon; and means for moving the outer surface of first donor member at a first velocity;

means for moving the outer surface of second donor member at a second velocity; wherein said first velocity is different than said second velocity to reduce a ghosting print defect, said first donor member develops a first ghost image on said imaging surface and said second donor member develops a second ghost image on said imaging surface that overlays said first ghost image by a predefined separation gap.

2. The apparatus of claim 1, wherein said predefined separation gap is approximately between 2 mm to 20 mm, and preferably between 5 mm and 20 mm.

3. The apparatus of claim 1, wherein said first donor member and second donor member have the same radius being rotated at different speeds to generate said predefined separation gap.

4. The apparatus of claim 1, wherein said first donor member and second donor member have different radii being rotated at same speed to generate said predefined separation gap.

5. A method for developing a latent image recorded on a movable imaging surface with a developer apparatus, including: a reservoir for storing a supply of developer material; a first donor member and a second donor member, said first and second donor members both being arranged to receive toner particles from said reservoir and to deliver toner particles to the image surface at locations spaced apart from each other in the direction of movement of the imaging surface thereby to develop the latent image thereon, said method comprising:

moving the outer surface of first donor member at a first velocity in a first direction;

moving the outer surface of second donor member at a second velocity; in said first direction; wherein said first velocity is slightly different than said second velocity to reduce a ghosting print defect:

developing a first ghost image on said imaging surface with said first donor member and developing a second ghost image on said imaging surface that overlays said first ghost image by a predefined separation gap with said second donor member.

6. The method of claim 5, further comprising providing said predefined separation gap of approximately between 2 mm to 20 mm, and preferable between 5 mm and 20 mm.

7. An electrographic printing machine having an apparatus for developing a latent image recorded on a movable imaging surface, including:

a reservoir for storing a supply of developer material;

a first donor member and a second donor member, said first and second donor members both being arranged to receive toner particles from said reservoir and to deliver toner particles to the image surface at locations spaced apart from each other in the direction of movement of the imaging surface thereby to develop the latent image thereon;

means for moving the outer surface of first donor member at a first velocity;

said first donor member develops a first ghost image on said imaging surface and said second donor member develops a second ghost image on said imaging surface that overlays said first ghost image by a predefined separation gap; and means for moving the outer surface of second donor member at a second velocity; wherein said first velocity is different than said second velocity to reduce a ghosting print defect.

8. The apparatus of claim 7, wherein said predefined separation gap is approximately between 2 mm to 20 mm, and preferably between 5 mm and 20 mm.

9. The apparatus of claim 7, wherein said first donor member and second donor member have the same radius being rotated at different speeds to generate said predefined separation gap.

10. The apparatus of claim 7, wherein said first donor member and second donor member have different radii being rotated at same speed to generate said predefined separation gap.

* * * * *